United States Patent [19]

Jaster

[11] Patent Number: 4,910,972

[45] Date of Patent: Mar. 27, 1990

[54] REFRIGERATOR SYSTEM WITH DUAL EVAPORATORS FOR HOUSEHOLD REFRIGERATORS

[75] Inventor: Heinz Jaster, Schenectady, N.Y.

[73] Assignee: General Electric Company, Schenectady, N.Y.

[21] Appl. No.: 351,988

[22] Filed: May 15, 1989

Related U.S. Application Data

[63] Continuation of Ser. No. 288,848, Dec. 23, 1988, abandoned.

[51] Int. Cl.[4] ..... F25B 7/00

[52] U.S. Cl. ..... 62/335; 62/510

[58] Field of Search ..... 62/510, 335

[56] References Cited

U.S. PATENT DOCUMENTS

| | | | |
|---|---|---|---|
| 2,500,688 | 3/1950 | Kellie | 62/115 |
| 2,519,010 | 8/1950 | Zearfoss, Jr. | 62/335 |
| 2,586,454 | 2/1952 | Brandin | 62/335 |
| 3,018,640 | 1/1962 | Heller et al. | 62/510 |
| 3,360,958 | 1/1968 | Miner | 62/470 |
| 3,848,422 | 11/1974 | Schibbye | 62/84 |
| 4,435,962 | 3/1984 | Mochizuki et al. | 62/510 |
| 4,439,998 | 4/1984 | Horvay et al. | 62/199 |
| 4,474,026 | 10/1984 | Mochizuki et al. | 62/510 |
| 4,742,694 | 5/1988 | Yamanaka et al. | 62/510 |
| 4,745,777 | 5/1988 | Morishita et al. | 62/509 |

FOREIGN PATENT DOCUMENTS

| | | |
|---|---|---|
| 431893 | 11/1911 | France . |
| 1134858 | 1/1985 | U.S.S.R. . |

OTHER PUBLICATIONS

"Refrigeration and Air Conditioning", W. F. Stoecker, 1958, McGraw Hill, pp. 57–61.

"Heat Pumps—Limitations and Potential", J. B. Comly, H. Jaster, J. P. Quaile, Technical Information Series, Sep. 1975, pp. 7, 8, and 18.

"Principles of Refrigeration", Roy J. Dossat, 2nd Ed., John WIley & Sons, Inc., 1976, pp. 240, 241, 430, 536.

*Primary Examiner*—Ronald C. Capossela

*Attorney, Agent, or Firm*—William H. Steinberg; James C. Davis, Jr.; Paul R. Webb, II

[57] ABSTRACT

A refrigerator system suitable for use in a household refrigerator having a freezer compartment and a fresh food compartment is provided. The refrigerator system includes a first expansion valve, a first evaporator for providing cooling to the freezer compartment, a first compressor, a second compressor, a condensor, a second expansion valve, and a second evaporator providing cooling to the fresh food compartment. All the above elements are connected together in series in that order, in a refrigerant flow relationship. A phase separator connects the second evaporator to the first expansion in a refrigerator flow relationship and the phase separator provides intercooling between the first and second compressors.

8 Claims, 5 Drawing Sheets

REFRIGERATOR SYSTEM WITH DUAL EVAPORATORS FOR HOUSEHOLD REFRIGERATORS

This application is a continuation, of application Ser. No. 288,848, filed 12/23/88 now abandoned.

BACKGROUND OF THE INVENTION

The present invention relates to household refrigerators operating with a vapor compression cycle and more particularly, to refrigerators with a two stage compressor.

Currently produced household refrigerators operate on the simple vapor compression cycle. The cycle includes a compressor a, condensor b, expansion valve c, evaporator d, and a two phase refrigerant. In the prior art refrigerator cycle of FIG. 1 a capillary tube acts as an expansion valve. The capillary tube is placed in close proximity with the suction line of the compressor to cool the capillary tube. The subcooling which occurs to the refrigerant in the capillary tube increases the cooling capacity per unit mass flow rate in the system thereby increasing system efficiency which more than compensates for the disadvantage of increasing the temperature of the gas supplied to the compressor. The evaporator in FIG. 1 operates at approximately −10° F. Refrigerator air is blown across the evaporator and the air flow is controlled so that part of the air flow goes to the freezer compartment and the remainder of the flow goes to the fresh food compartment. The refrigerator cycle, therefore, produces its refrigeration effect at a temperature which is appropriate for the freezer, but lower than it needs to be for the fresh food compartment. Since the mechanical energy required to produce cooling at low temperatures is greater than it is at higher temperatures, the simple vapor compression cycle uses more mechanical energy than one which produces cooling at two temperature levels.

A well known procedure to reduce mechanical energy use is to operate two independent refrigeration cycles, one to serve the freezer at low temperatures and one to serve the fresh food compartment at an intermediate temperature. Such a system, however, is very costly.

Another problem which occurs in cooling for freezer operation in the simple vapor compression cycle, is the large temperature difference between the inlet and outlet temperatures of the compressor. The gas exiting the compressor is superheated, which represents a thermodynamic irreversibility which results in a relatively low thermodynamic efficiency. Lowering the amount of superheat will provide for decreased use of mechanical energy and therefore greater efficiency.

It is an object of the present invention to provide a refrigerator system for use in household refrigerators which has improved thermodynamic efficiency.

It is a further object of the present invention to provide a refrigerator system suitable for use in household refrigerators which reduces the gas temperature at the compressor discharge ports.

SUMMARY OF THE INVENTION

In one aspect of the present invention, a refrigerator system suitable for use in a household refrigerator having a freezer compartment a fresh food compartment is provided. The refrigerator system includes a first expansion valve, a first evaporator for providing cooling to the freezer compartment, a first compressor, a second compressor, a condensor, a second expansion valve, and a second evaporator providing cooling to the fresh food compartment. All the above elements are connected together in series in that order, in a refrigerant flow relationship. A phase separator connects the second evaporator to the first expansion valve in a refrigerator flow relationship and the phase separator provides intercooling between the first and second compressors.

BRIEF DESCRIPTION OF THE INVENTION

The subject matter which is regarded as the invention is particularly pointed out and distinctly claimed in the concluding portion of the specification. The invention, however, both as to organization and method of practice, together with further objects and advantages thereof, may best be understood by reference to the following description taken in conjunction with the accompanying figures in which:

DETAILED DESCRIPTION OF THE INVENTION

Figure 2:
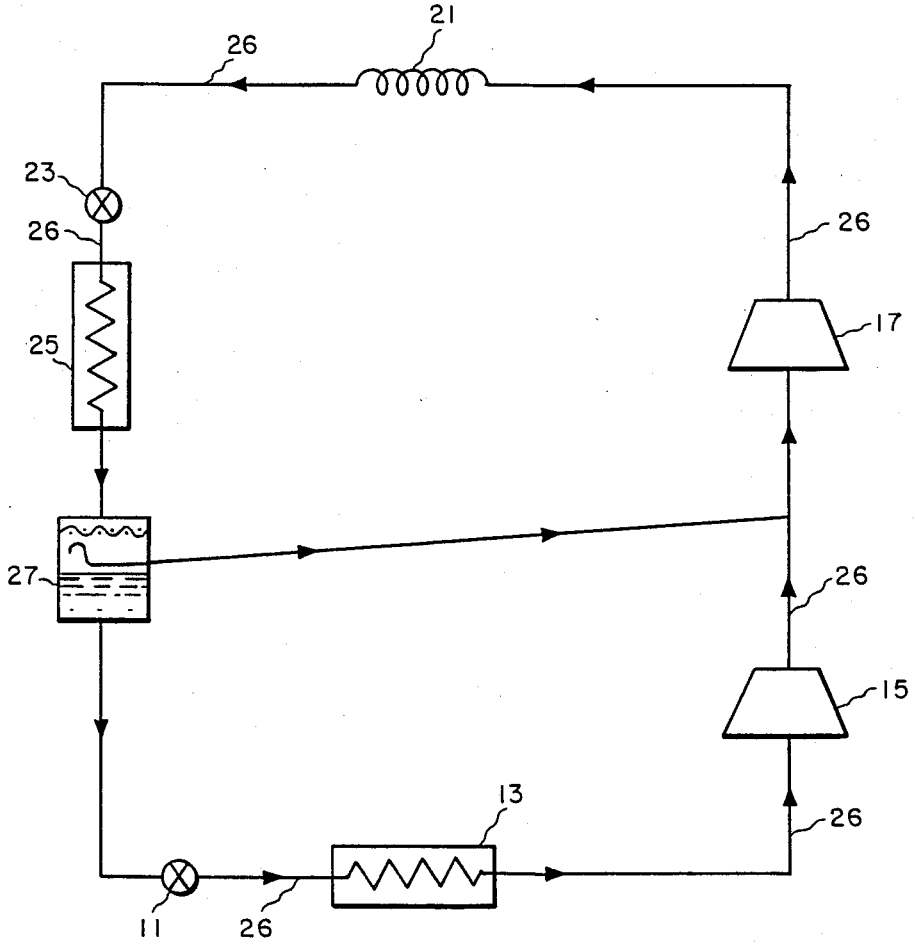
FIG. 2 is a schematic representation of one embodiment of a dual evaporator two-stage system in accordance with the present invention.
Figure 3:
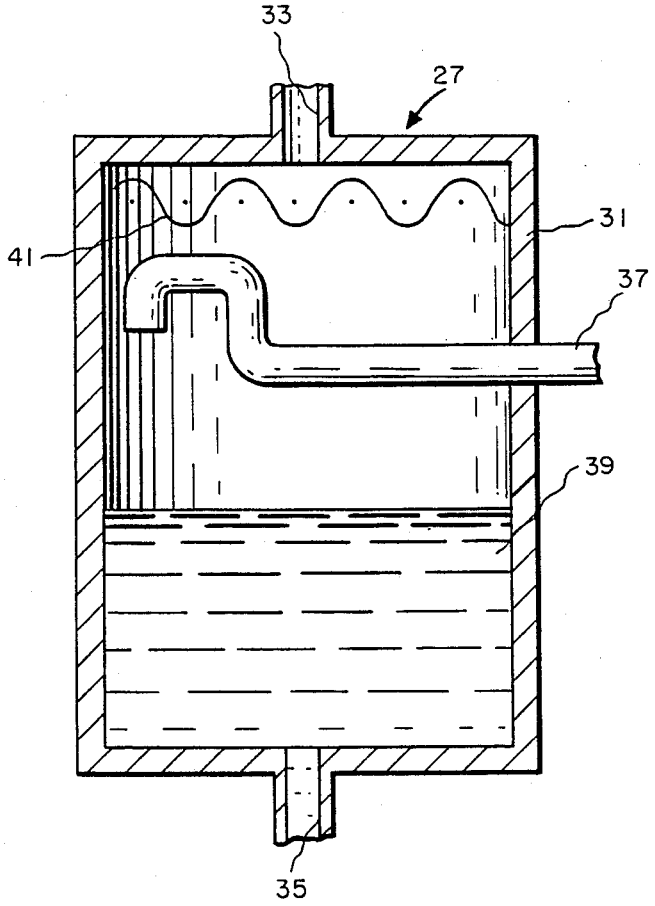
FIG. 3 is a sectional view of the phase separator of FIG. 2.

Referring now to the drawing and particularly FIG. 2 thereof, one embodiment of a dual evaporator two-stage system is shown. The system comprises a first expansion valve 11, a first evaporator 13, a first and second compressor 15 and 17, respectively, a condensor 21, a second expansion valve 23, and a second evaporator 25, connected together in that order, in series, in a refrigerant flow relationship by conduit 26. A phase separator 27, shown in cross section in FIG. 3, comprises a closed receptacle 31 having at the upper portion an inlet 33 for admitting liquid and gaseous phase refrigerant and having two outlets 35 and 37. A screen 44 is located in the upper portion of the receptacle to remove any solid material carried along with the refrigerant when entering the inlet 33. The first outlet 35 is located at the bottom of the receptacle 31 and provides liquid refrigerant 39. The second outlet 37 is provided by a conduit which extends from the interior of the upper portion of the receptacle to the exterior. The conduit is in flow communication with the upper portion and is arranged so that liquid refrigerant entering the upper portion of the receptacle through inlet 33 cannot enter the open end of the conduit. Two phase refrigerant from the outlet of the second evaporator 25 is connected to the inlet 33 of the phase separator 27. The phase separator provides liquid refrigerant to the first expansion valve 11. The phase separator also provides saturated refrigerant vapor which combines with vapor output by the first compressor 15 and together are connected to the inlet of the second compressor 17.

In operation, the first evaporator 13 contains refrigerant at a temperature of approximately −10° F. for cooling the freezer compartment. The second evaporator 25 contains the refrigerant at a temperature of approximately 25° F. for cooling the fresh food compartment.

The first expansion valve 11 is adjusted to obtain just barely dry gas flow, which can be accomplished, for example, by observing a sight glass located in the conduit 26 between the first evaporator 13 and the first compressor 15. The gas enters the first compressor 15 stage and is compressed. The gas discharged from the first compressor is mixed with gas at the saturation temperature from the phase separator 27 and the two gases are further compressed by the second compressor 17. The high temperature, high pressure discharge gas from the second compressor is condensed in condensor 21 with the expansion valve 23 adjusted to obtain some subcooling of the liquid exiting the condensor. This can be accomplished by observing a sight glass situated between the condensor 21 and the second expansion valve 23. The liquid refrigerant condensed in the condensor 21 passes through the second expansion valve where it expands from the high pressure of the condensor 21 to a lower intermediate pressure in the second evaporator 25. The expansion of the liquid causes part of the liquid to evaporate and cool the remainder to the second evaporator temperature. The liquid and gas phase refrigerant enters the phase separator 27. Liquid refrigerant accumulates in the lower portion of the receptacle and gas accumulates in the upper portion. The phase separator supplies the gas portion to be combined with the gas exiting the first stage compressor 15. The gas from the phase separator is at approximately 25° F. and cools the gas exiting from the first stage compressor, thereby lowering the gas temperature entering the second compressor 17 from what it would have otherwise have been without the intercooling. The liquid of the two phase mixture from the second evaporator 25 flows from the phase separator 27 through the first expansion valve 11 causing the refrigerant to a still lower pressure. The remaining liquid evaporates in the first evaporator 13 cooling the evaporator to approximately −10° F. A sufficient refrigerant charge is supplied to the system so that the desired liquid level can be maintained in the phase separator.

The pressure ratio of the two compressors is determined by the refrigerant used and the temperatures at which the evaporators are to operate. The pressure at the input to the first compressor 15 is determined by the pressure at which the refrigerant exists in two phase equilibrium at −10° F. The pressure at the output of the first compressor is determined by the saturation pressure of the refrigerant at 25° F. The temperature of the condensor 21 has to be greater than that of the ambient temperature in order to function as a heat exchanger under a wide range of operating conditions. If the condensor is to operate at 105° F., for example, then the pressure of the refrigerant at saturation can be determined. The volume displacement capability of the compressors are determined by the amount of cooling capacity the system requires at each of the two temperature levels, which determines the mass flow rate of the refrigerant through the compressors.

The dual evaporator two-stage cycle requires less mechanical energy compared to a single evaporator single compressor cycle with the same cooling capacity. The efficiency advantages come about due to the fact that the gas leaving the higher temperature evaporator is compressed from an intermediate pressure, rather than from the lower pressure of the gas leaving the lower temperature evaporator. Also contributing to improved efficiency is the cooling of the gas exiting the first compressor by the addition of gas cooled to saturation temperature from the phase separator. The cooling of the gas entering the second compressor reduces the mechanical energy requirement of the second compressor.

Figure 4:
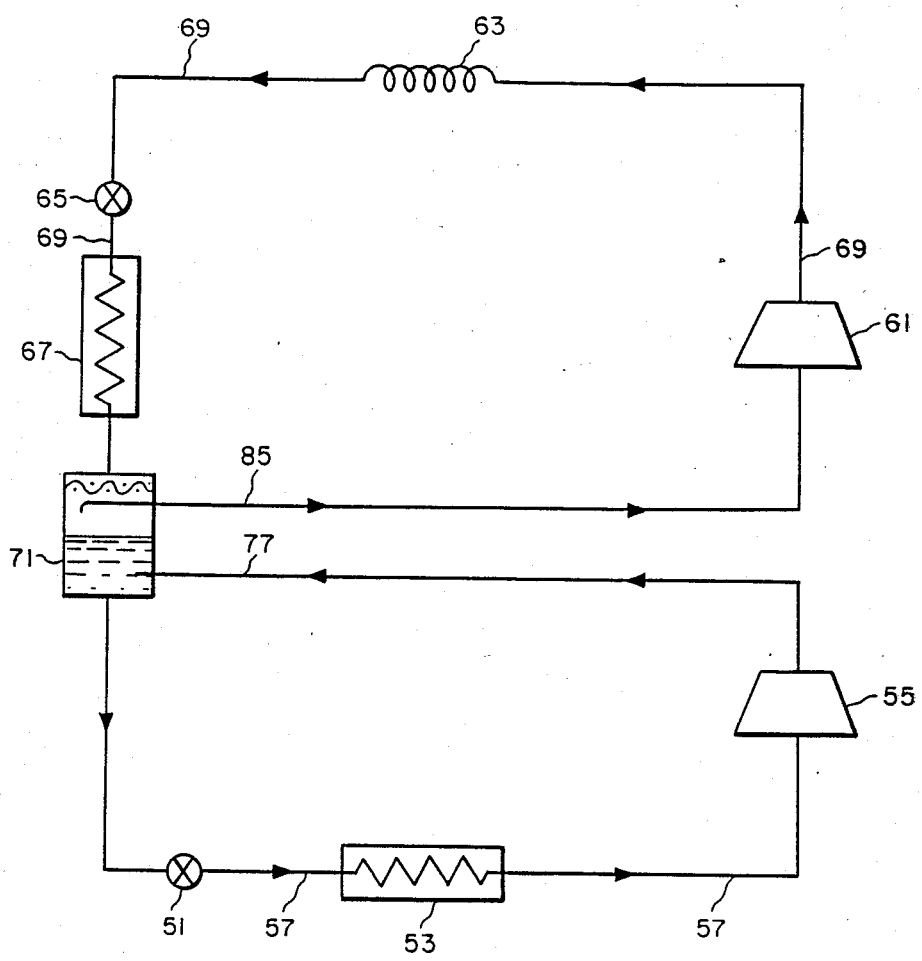
FIG. 4 is a schematic representation of another embodiment of a dual evaporator two-stage system in accordance with the present invention.

Another embodiment of the present invention is shown in FIG. 4. The system comprises a first expansion valve 51, a first evaporator 53, and a first compressor 55, all of which are connected in series in that order in a refrigerant flow relationship by conduit 57. A second compressor 61, a condensor 63, a second expansion valve 65, and a second evaporator 67, are connected in series in that order, in a refrigerant flow relationship by conduit 69. A phase separator 71, shown in cross section in FIG. 5, comprises a closed receptacle 73 having at the upper portion a first inlet 75 for admitting liquid and gaseous phase refrigerant, a second inlet 77 for introducing gas refrigerant below a liquid level 81 in the lower portion of the receptacle and two outlets 83 and 85. A screen 87 is located in the upper portion of the receptacle to remove any solid material carried along with the refrigerant when entering the first inlet. The first outlet 83 is located at the bottom of the receptacle and provides liquid refrigerant. The second outlet 85 is provided by a conduit located in the upper portion of the receptacle and is arranged so that liquid refrigerant entering the first inlet cannot enter the open end of the conduit 85. Two phase refrigerant from the outlet of the second evaporator 67 enters the first inlet 75 of the phase separator. The phase separator provides liquid refrigerant to the first expansion valve 52 from outlet 83 of the phase separator. The discharge gas refrigerant from the first compressor 55 is introduced into the receptacle 75 through the second inlet 77 where it mixes with the liquid refrigerant. The second outlet 85 delivers gas at the saturation temperature of the liquid to the second compressor 61.

In operation, the first evaporator 53 contains refrigerant at a temperature of approximately −10° F. for cooling the freezer compartment. The second evaporator 67 contains refrigerant at a temperature of approximately 25° F. for cooling the fresh food compartment. The first expansion valve 51 is adjusted to obtain just barely dry gas flow such as by observing a sight glass installed in the conduit 57 between the evaporator 53 and the compressor 55. The gas enters the first compressor stage 55 and is compressed. The gas discharged from the first compressor is mixed with and is in direct contact with liquid refrigerant in the phase separator 71, reducing the gas temperature to the saturation temperature. Some of the liquid refrigerant is evaporated by the gas entering the second inlet. The liquid refrigerant that evaporates cools the incoming gas from the first compressor 55 to the saturation gas temperature. Saturated gas from the upper portion of the phase separator flows into the inlet of the second compressor 61. The high temperature, high pressure gas discharged by the second compressor 61 is condensed in a condensor 63 with the throttling adjusted by the second expansion valve 65 to obtain some subcooling. This can be accomplished, for example, by observing the sight glass situated between the condensor 63 and the second evaporator. The liquid refrigerant condensed in condensor passes through the second expansion valve 65 where it expands from the high pressure in the condensor to a lower intermediate pressure in the second evaporator 67. The expansion of the liquid causes part of the liquid to evaporate and cools the remainder to the second evaporator temperature. The liquid and gas phase refrigerant enters the phase separator 71. The liquid accumulates in the lower portion of the receptacle and the gas in the upper portion. Liquid refrigerant from the phase separator flows through the first expansion valve 51 causing the refrigerant to expand to a still lower pressure. The remaining liquid evaporates in the evaporator cooling the evaporator to approximately −10° F. A sufficient refrigerant charge is supplied so that the desired liquid level can be maintained in the phase separator 71.

The dual evaporator two stage cycle requires 29% less mechanical energy compared to a single evaporator single compressor cycle with the same cooling capacity. The efficiency advantages come about due to the fact that the gas leaving the higher temperature evaporator 67 (second evaporator) is compressed from an intermediate pressure rather than from the lower pressure of the gas leaving the lower temperature evaporator 53. Also contributing to the improved efficiency is the cooling of the gas leaving the first compressor 55 to the saturation temperature, before compression to the system's high pressure in the second compressor 61. The cycle shown in FIG. 2 is calculated to be more efficient than the cycle in FIG. 4 by approximately While the arrangement of FIG. 2 results in a higher gas inlet temperature to the second compressor 61 and thereby requires greater compression work, the cycle of FIG. 2 makes available more liquid at intermediate pressure for expansion to the low temperature evaporator 53 (first evaporator) thereby increasing the cycle's efficiency. FIG. 2 has a higher inlet temperature to the second compressor since not all the gas supplied to the second compressor is cooled to the saturation temperature as is done in the cycle of FIG. 4.

When refrigerant R-12 is used the relative compressor sizes (displacements) in the 2 stage dual evaporator cycles of both FIGS. 2 and 4 of the first and second compressors are 0.27 and 0.45 compared to a compressor size of 1 for the simple vapor compression cycle, for the same overall refrigeration capacity.

In the embodiments of FIGS. 2 and 4 the compressors can be of the reciprocating type with hermetically sealed motors or of the rotary type with hermetically sealed motors or of any positive displacement type with hermetically sealed motors. The first compressor when refrigerant R-12 is used can be very small and operates against a pressure ratio of only 2, which could allow the use of, for example, an inexpensive diaphragm compressor. Improved efficiency can be achieved by operating both compressors from a single motor. Since a larger motor can be more efficient than two smaller motors providing the same total power.

Figure 1:
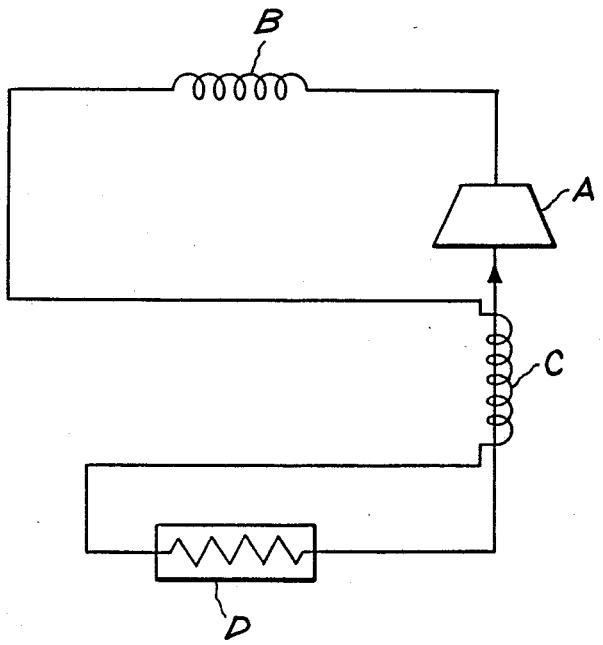
Fig. 1 (Prior Art)
FIG. 1 is a schematic representation of a prior art vapor compression system used in a household refrigerator.

Performance calculations for the cycles of FIG. 1, FIG. 2, and FIG. 4 follow. All cycles are assumed to use R12 refrigerant and the total cooling capacity of each of the cycles was assumed to be 1000 Btu/hr. In addition, all cycles are assumed to use rotary compressors with hermetically sealed motors cooled by refrigerant at the discharge pressure of the compressor. For the cycle of FIG. 1 the evaporator exit saturation temperature was assumed to be −10° F., and have a pressure drop of 1 psi and an exit superheat of 0°. The compressor adiabatic efficiency was assumed to be 0.61, motor efficiency 0.8 and additional heating of suction gas due to heat transfer from the compressor shell 43° F. The capillary tube heat transfer to the suction line of the compressor results in suction gas of heating of 98° F. The condensor entrance saturation temperature is assumed to be 130° F., the pressure drop 10 psi, and exit subcooling 5° F.

Based on these parameters, the motor discharge temperature is calculated to be 429° F., refrigerant flow rate 18.6 lbm/hr, compressor power 270 Watts and the coefficient of performance 1.09.

For the cycles of FIGS. 2 and 4 the first evaporator was assumed to have an exit saturation temperature of −10° F., with a pressure drop of 1 psi and an exit superheat of 0° F. The second evaporator is assumed to have an exit temperature of 25° F. and 0 psi pressure drop. The first and second compressor have an adiabatic efficiency of 0.7 and a motor efficiency of 0.8. The first compressor produces an additional superheating of suction gas due to heat transfer from the compressor shell of 5° F. The second compressor has an additional superheating of suction gas of 10° F. The condensor has an entrance saturation temperature of 130° F., a pressure drop of 10 psi and an exit subcooling of 5° F. The cooling capacity of 1000 Btu/hr is divided equally between two evaporators.

The computed results from the above parameters for the cycle in FIG. 2 are a second compressor discharge gas temperature of 208° F. and a first stage compressor discharge gas temperature of 66° F. The compressor flow rates of the first and second compressors are 8.0 lbm/hr and 24.7 lbm/hr, respectively. The first and second compressor power consumptions are 22.2 and 164 watts, respectively. The coefficient of performance is 1.58.

The computed results for the cycle of FIG. 4 using the above parameters are a first and second compressor discharge gas temperature of 66° and 208° F., respectively. A first and second compressor flow rate of 23.6 and 8.0 lbm/hr, respectively. A first and second compressor power consumption of 22.2 and 156.2 watts. The coefficient of performance was calculated to be 1.64.

Figure 5:
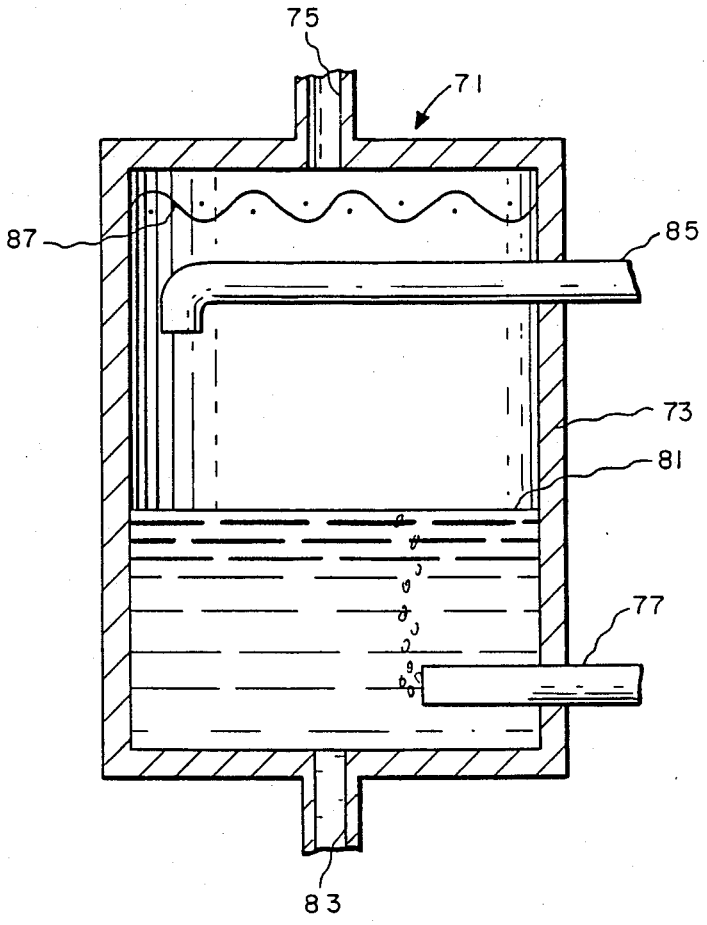
FIG. 5 is a sectional view of the phase separator of FIG. 4.

The system of FIG. 4 can be modified by changing the operation of the phase separator of FIG. 5. If the second inlet 77 is connected to the conduit of the second outlet 85, then the gas from the outlet of the first compressor would not be in direct contact with the liquid refrigerant but would still be cooled, although not to the saturation temperature. The phase separator would provide intercooling between the two compressors, operating as heat exchanger, but not as much cooling as when the gas is in direct contact with the liquid refrigerant.

The foregoing has described a refrigerator system with dual evaporators suitable for use with household refrigerators that has improved thermodynamic efficiency.

While the invention has been particularly shown and described with reference to several preferred embodiments thereof, it will be understood by those skilled in the art that various changes in form and detail may be made without departing from the spirit and scope of the invention.

What I claim is:

1. A refrigerator system for use in a refrigerator having a freezer compartment and a fresh food compartment comprising:

a first expansion valve;

a first evaporator for providing cooling to the freezer compartment;

a first and second compressor;

a condensor;

a second expansion valve;

a second evaporator for providing cooling to the fresh food compartment, all the above elements connected together in series, in that order, in a refrigerant flow relationship; and a phase separator connecting said second evaporator to said first expansion valve in a refrigerant flow relationship, said phase separator providing intercooling between said first and second compressors.

2. The refrigerator system of claim 1 wherein said phase separator comprises means adapted for receiving liquid and gas phase refrigerant from said second evaporator and means for providing liquid refrigerant to said first expansion valve.

3. The refrigerator system of claim 2 wherein said phase separator comprises means for providing saturated gas to the second compressor so that said second compressor receives gas phase refrigerant from said first compressor and from said phase separator.

4. The refrigerator system of claim 3 wherein said phase separator comprises a receptacle for accumulating liquid refrigerant in the lower portion and gas refrigerant in the upper portion said receptacle comprising means for supplying saturated gas to said second compressor

5. The refrigerator system of claim 2 wherein said phase separator comprises means for receiving gas refrigerant from said first compressor and providing gas at the saturated gas temperature to said second compressor.

6. The refrigerator system of claim 4 wherein said phase separator comprises a receptacle for accumulating liquid refrigerant in the lower portion and gas refrigerant in the upper portion, said receptacle comprising means for introducing gas from said first compressor into the receptacle below the liquid level refrigerant and means situated above the liquid level for supplying saturated gas to said second compressor.

7. A refrigerator system for use in a refrigerator having a freezer compartment and a fresh food compartment comprising:

a first expansion valve;

a first evaporator for providing cooling to the freezer compartment;

a first and second compressor;

a condensor;

a second expansion valve;

a second evaporator for providing cooling to the fresh food compartment, all the above elements connected together in series, in that order, in a refrigerant flow relationship; and a phase separator means for receiving liquid and gas phase refrigerant from said second evaporator and supplying liquid refrigerant to said first expansion valve and saturated refrigerant gas to said second compressor, so that gas from said first compressor and from said phase separator are supplied to said second compressor.

8. A refrigerator system for use in a refrigerator having a freezer compartment and a freak food compartment comprising:

a first expansion valve;

a first evaporator for providing cooling to the freezer compartment;

a first compressor, said first expansion valve, said first evaporator and said first compressor connected together in series, in that order, in a refrigerant flow relationship;

a second compressor;

a condensor;

a second expansion valve;

a second evaporator for providing cooling to the fresh food compartment, said second compressor, said condensor, said second expansion valve, said second evaporator connected together in series, in that order, in a refrigerant flow relationship; and a phase separator means for receiving liquid and gas phase refrigerant from said second evaporator and supplying liquid refrigerant to said first expansion valve and for receiving superheated gas refrigerant from said first compressor and providing gas at the saturated gas temperature to said second compressor.

* * * * *